United States Patent [19]

Vogt

[11] B 3,990,165

[45] Nov. 9, 1976

[54] MECHANIC DIGITAL DISPLAY DEVICE

[75] Inventor: Paul Vogt, Les Hauts Geneveys, Switzerland

[73] Assignee: Ebauches S.A., Neuchatel, Switzerland

[22] Filed: Aug. 1, 1974

[21] Appl. No.: 493,981

[44] Published under the second Trial Voluntary Protest Program on March 9, 1976 as document No. B 493,981.

[30] Foreign Application Priority Data

Aug. 9, 1973 Switzerland ..... 11499/73

[52] U.S. Cl. ..... 40/28 C

[51] Int. Cl.[2] ..... G09F 9/30

[58] Field of Search ..... 40/28 C, 36, 132 D, 40/130 E; 340/336, 334, 324 R, 339, 378 R, 378 A

[56] References Cited

UNITED STATES PATENTS

| | | | |
|---|---|---|---|
| 1,091,335 | 3/1914 | Herrmann | 40/28 C |
| 1,200,437 | 10/1916 | Harris | 40/28 C UX |
| 1,737,573 | 12/1929 | De Mole | 40/52 R |
| 3,537,197 | 11/1970 | Smith | 40/28 C |

FOREIGN PATENTS OR APPLICATIONS

| | | | |
|---|---|---|---|
| 13,031 | 1906 | United Kingdom | 40/130 E |

*Primary Examiner*—Louis G. Mancene
*Assistant Examiner*—John F. Pitrelli
*Attorney, Agent, or Firm*—Silverman & Cass, Ltd.

[57] ABSTRACT

A mechanical digital display device in which a pair of display screens is arranged within a display zone. The screens are secured to a respective pivot lever movable in two planes to move the screens in horizontal and vertical directions and thereby form numbers or the like to be displayed.

4 Claims, 3 Drawing Figures

MECHANIC DIGITAL DISPLAY DEVICE

The present invention relates to a mechanical digital display device.

SUMMARY OF THE INVENTION

The device of the invention comprises a quadrangular zone having two quadrangular screens arranged thereon, the screens being respect to each other, the total surface of the screens being less than that of the said quadrangular zone, the screens being adapted to effect translational movements, and being submitted to the action of a control device for moving them into different positions, so as to permit the arrangement of the free spaces between the screens and/or between them and the edges of the quadrangular zone to be varied enabling the formation of any one of the ten numerals by means of the said free spaces.

BRIEF DESCRIPTION OF THE DRAWING

The drawing shows by way of example, one enbodiment constructed in accordance with the invention.

DECRIPTION OF THE PREFERRED EMBODIMENT

Figure 1:
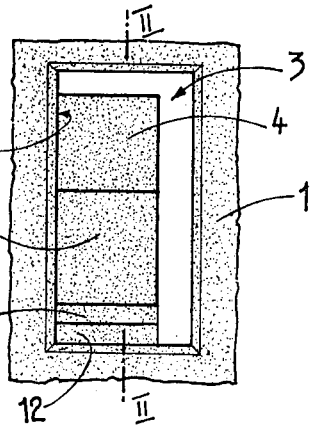
FIG. 1 is an elevational view of a digital display device.
Figure 2:
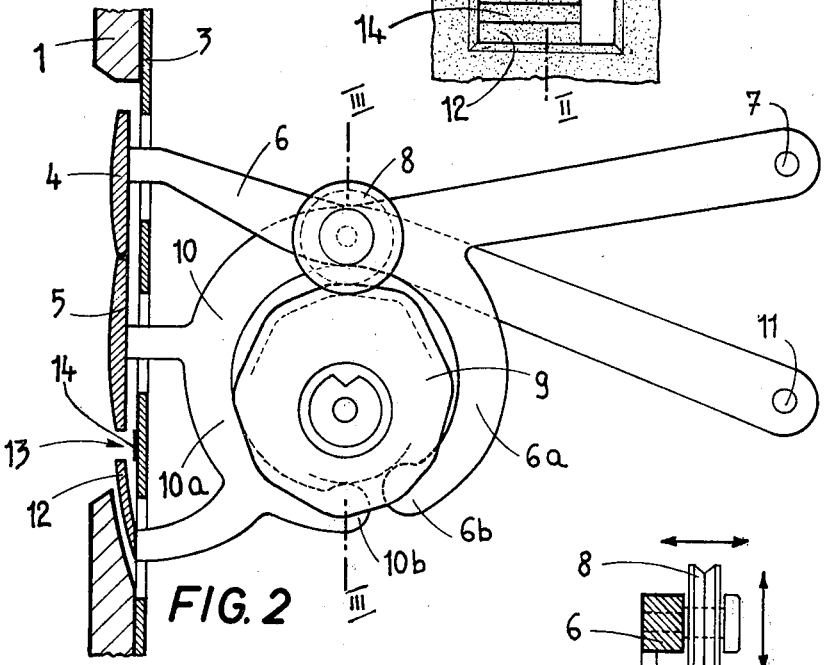
FIG. 2 is a sectional view taken along the line II—II of FIG. 1, at a larger scale.
Figure 3:
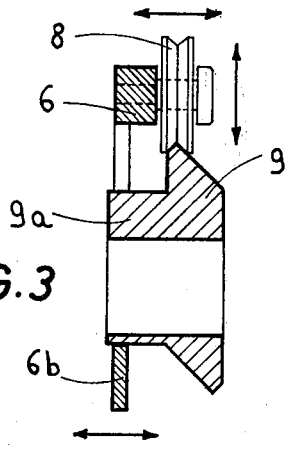
FIG. 3 is a sectional view taken along the line III—III of FIG. 2, in which only a part of the mechanism has been represented.

The display device represented comprises a front plate 1 in which has been cut a rectangular opening 2 through which appears a second plate, designated by 3, the appearance of which is different from that of plate 1. Plate 1 may be colored black, for instance, while the visible portion of plate 3 will be white.

Two quadrangular screens 4 and 5, of the same appearance as plate 1, i.e. black, the total surface of which is less than the surface of the opening 2, can move themselves independently of each other in opening 2 in a double movement of translation. The screen 4 is secured to the end of a lever 6 articulated at 7 on the frame of the apparatus; the lever 6 carries a roller 8 which bears on a control cam 9. The lever 6 also is movable parallel to its axis of articulation 7. For this purpose, the roller 8 is provided with a groove and is engaged on the cam 9. The cam 9 bidirectional, and the right section of the cam is profiled. Thus, the rotation of the cam causes the displacements of the lever 6 at the same time around its axis of articulation and parallel thereto, these displacements producing movements of the screen 4 according to its two directions of displacement.

Since the lever 6 is not submitted to the action of any spring urging the roller 8 to be maintained in contact with the cam 9, the lever is provided with an extension **6*a* extending under the cam. The extention 6*a* terminates with a heel 6*b* which maintains contact with a portion 9*a* of the cam at a point on the cam which is substantially diametrically opposed to the point of contact of the roller 8** on the cam. The extension thus prevents the roller from leaving the cam during operation.

Similarly, the screen 5 is carried by a lever 10 articulated at 11. Lever 10 carries a roller identical to the roller 8 which is maintained in contact with a control cam coaxial with cam 9. The latter roller is not visible in the drawing since it is located behind the cam 9. An extension **10*a* of the lever 10, terminates at a heel 10*b*** and forms a counter-bearing member similar to heel **6*b* of the extension 6*a* of the lever 6. Extension 10*a* carries a third screen 12, the appearance of which is identical to that of screens 4 and 5, that is to say black; the screen 12 is thus rigidly connected with the screen 5. The screen 12 is of the same width as the screen 5 and is separated therefrom by a transversal space 13 extending parallel to the short sides of the rectangular opening 2 of the front plate 1. The rear plate 3 is provided with a transversal zone 14, also parallel to the short sides of the rectangular opening 2. The appearance of the zone 14 is identical to that of plate 1 and of screens 4, 5 and 12. Zone 14, is passed over by the free space 13 remaining between the screens 5 and 12 during the displacements of these two screens parallel to the large sides of the rectangular opening 2**.

Due to the arrangement as disclosed and represented, the screens 4, on the one hand, and 5 and 12, on the other hand, can be brought into several positions in which a free transversal space positioned therebetween appears and disappears. Further, the position of the free spaces between the screens and the edges of the rectangular opening 2 varies, so as to permit the foundation of any one of the ten numerals. The black zone 14 carried by the rear plate 3 appears through the free space 13 situated between the screens 5 and 12 during the display of numerals 1, 4 and 7, which must present no transversal lower segment.

It is to be noted that the rear plate 3 may, be translucent, the device comprising then lighting means situated behind the plate 3, so as to permit reading of the apparatus during the night.

What I claim is:

1. A mechanical digital display device comprising, a front plate and a rear plate disposed behind the front plate, the front plate having an opening therein forming a rectangular display zone, a pair of colored rectangular display screens arranged one beneath the other within the zone in front of the rear plate and movable towards and away from each other, the total surface area of the screens being less than the area defined within the zone, each screen being rigidly secured to a respective pivot lever passing through passageways in the rear plate, each lever carrying a cam-operated cam disc for controlling the movement of the screens, one of said screens being divided into two portions rigidly connected with each other and arranged with a space therebetween, said space defined by said one screen being of rectangular configuration with the long dimension thereof disposed parallel to a short edge of the zone, and a covering strip disposed on the rear plate, the strip having the same color as the screens.

2. A device as claimed in claim 1 in which the space between the portions of the one screen sweeps over and away from the strip during displacements of said one screen.

3. A device as claimed in claim 1 in which said levers are adapted to move parallel to their pivotal axes, the cam associated with each cam disc being of generally right-section profile and each cam disc being of configuration for mating engagement upon its respective cam, and the cams being adapted for bidirectional movement, whereby the levers are operable to move around their pivot axes and parallel thereto to effect movement of the screens in vertical and horizontal directions.

4. A device as claimed in claim 1 in which said levers each include extending arms disposed partially around a respective cam, said arms being operable to maintain contact of the cam discs with their respective roller.

* * * * *